United States Patent [19]

Puglisi

[11] Patent Number: 5,075,834

[45] Date of Patent: Dec. 24, 1991

[54] RETRACTABLE LIGHT FIXTURE

[76] Inventor: Daniel G. Puglisi, 476 Copperstone Cir., Casselberry, Fla. 32707

[21] Appl. No.: 674,127

[22] Filed: Mar. 25, 1991

[51] Int. Cl.[5] ..... F21S 1/00

[52] U.S. Cl. ..... 362/386; 362/153.1; 362/286; 362/364; 362/394

[58] Field of Search ..... 362/386, 802, 386, 153, 362/153.1, 394, 285, 364

[56] References Cited

U.S. PATENT DOCUMENTS

| | | | |
|---|---|---|---|
| 4,974,134 | 11/1990 | Bourne | 362/386 X |
| 4,984,139 | 1/1991 | Goggia | 362/153.1 |
| 5,003,441 | 3/1991 | Crowe et al. | 362/286 X |

*Primary Examiner*—Stephen F. Husar

*Attorney, Agent, or Firm*—William M. Hobby, III

[57] ABSTRACT

A retractable light fixture apparatus has a housing having sides, a bottom, and an open end having a cover attached thereto. An electrically actuated lamp solenoid is attached inside the housing and has a solenoid arm having a lamp attached to the end thereof for raising the lamp from inside the housing through the housing cover when the solenoid is in an extended position and for lowering the lamp back into the housing when the lamp solenoid arm is lowered. An electrical conductor is connected from an electrical power source to the lamp solenoid and to the lamp for powering the lamp and solenoid. The electrical conductor has a remote switch therein for turning the power to the lamp on and off. A system for latching has a latching solenoid for holding the lamp solenoid and lamp thereon in an extended position. The latching system disengages the power to the lamp solenoid when the latch solenoid is in a latch position and simultaneously switches on the power to the lamp so that the light fixture raises and lowers the lamp and turns the lamp on and off upon the electric power being applied to the light fixture by actuating a remote switch.

9 Claims, 3 Drawing Sheets

RETRACTABLE LIGHT FIXTURE

BACKGROUND OF THE INVENTION

This invention relates to light fixtures and particularly to light fixtures having a lamp movable between extended and retracted positions.

The use of exterior lighting has been quite popular in the U.S. and particularly in the sunbelt states of the United States where much activity takes place out of doors after dark because of the weather and where in lighting is used to accentuate the extensive decorative landscaping employed because of the favorable year round weather conditions. In recent years, low voltage lighting has become particularly popular for decorative lighting inasmuch as lower voltage and lower wattage bulbs provide a pleasant-like atmosphere with low power consumption and long life equipment. Most lighting fixtures employed for exterior lighting, however, utilizes ugly, inconvenient and, in many cases, unsafe lighting fixtures. Fixtures placed alone, adjacent a sidewalk or pathway present objects over which a person may fall when attention is not specifically directed thereto as by the lighting thereof. Mowing around such fixtures in a lawn becomes an inconvenient task requiring separate attention with hand shears or powered edger adapted for, such use.

In the prior Bivens U.S. Pat. No., #4,180,850, a retractable light fixture uses a hydraulically operated retractable light adapted for decorative landscape lighting applications in which a retractable hollow cylinder carries a lightbulb which is retracted into a hollow body and which operates similar to a hydraulic piston mounted in a hydraulic cylinder housing and has a hydraulic line attached thereto for forcing the piston portion out of the housing to raise and lower the light. In the Bourne U.S. Pat. No., #4,974,134, an illuminated device having an underground storage position is provided which uses a clear lens to protect a lightbulb mounted in an inner housing which is telescoped upward within an outer housing buried in the ground when an electric motor is activated to drive a rotating screw which lifts the inner housing relative to the outer housing. A pair of microswitches turn the electric motor on and off when it reaches it limits. In the Arneson et al. U.S. Pat. No., #2,738,492, a signal light for automotive vehicles can be raised over the automobile for making a warning light, such as used on police cars and ambulances, more visible to warn other vehicles of a danger. In addition, there are numerous automobile lights which have retracted and raised positions to assist in improving the aerodynamics of the vehicle by having the headlight recessed when not in use. One such structure can be seen in the Matsuura et al. U.S. Pat. No., #4,432,040.

In contrast to these prior art devices, the present invention provides a simplified electrical circuit in a recessed lighting fixture which can be turning the remote electrical switch on and off. When the switch is turned on, the light is automatically turned off, the lighting fixture lamp is turned off and returned into the housing which is typically mounted in the earth. The complexities of utilizing separate fluid lines for raising and lowering a lamp fixture and the complexities of an electric motor driving a screw are eliminated with a simplified electro-mechanical circuit.

SUMMARY OF THE INVENTION

A retractable light fixture apparatus has a housing having sides, a bottom, and an open end having a cover attached thereto. An electrically actuated lamp solenoid is attached inside the housing and has a solenoid arm having a lamp attached to the end thereof for raising the lamp from inside the housing through the housing cover when the solenoid is in an extended position and for lowering the lamp back into the housing when the lamp solenoid arm is lowered. An electrical conductor is connected from an electrical power source to the lamp solenoid and to the lamp for powering the lamp and solenoid. The electrical conductor has a remote switch therein for turning the power to the lamp on and off. A system for latching has a latching solenoid for holding the lamp solenoid and lamp thereon in an extended position. The latching system disengages the power to the lamp solenoid when the latch solenoid is in a latch position and simultaneously switches on the power to the lamp so that the light fixture raises and lowers the lamp and turns the lamp on and off upon the electric power being applied to the light fixture by actuating a remote switch. The latch solenoid is a spring loaded switch solenoid which has a solenoid arm which is extended when the power is turned on to drive the latch solenoid arm into a notch in the lamp solenoid arm to hold the lamp solenoid arm and the lamp in an extended position. The switch or relay is interconnected with the lamp solenoid to turn the lamp on and the lamp solenoid power off once the light has been extended from the housing and to release the lamp and lamp solenoid to return to within the housing once the power is cut to the latch solenoid. An alternate embodiment has the lamp attached to the housing cover which is hinged to the housing and which is actuated by a lamp solenoid which is movably attached to the bottom of the housing and pinned to the housing cover and lamp.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
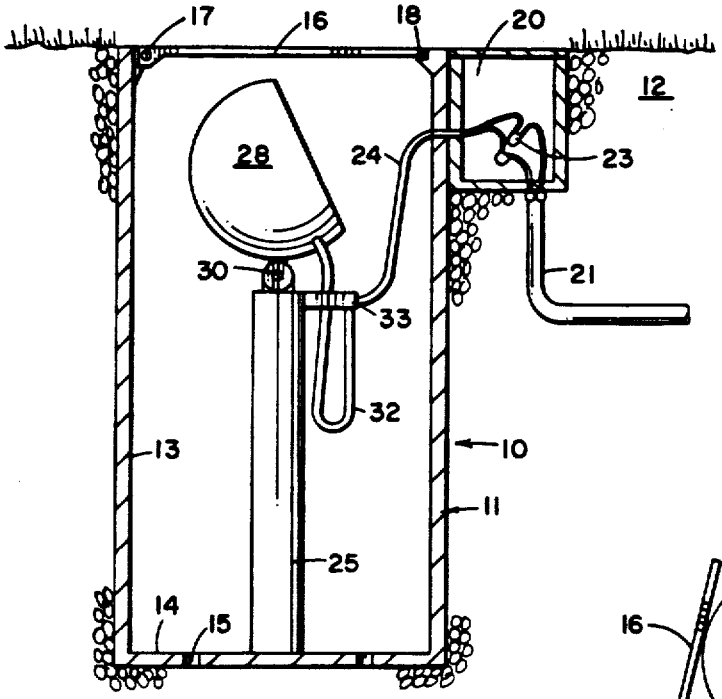
FIG. 1 is a sectional view of a retractable light fixture mounted in the earth in a retracted position in accordance with the present invention.
Figure 2:
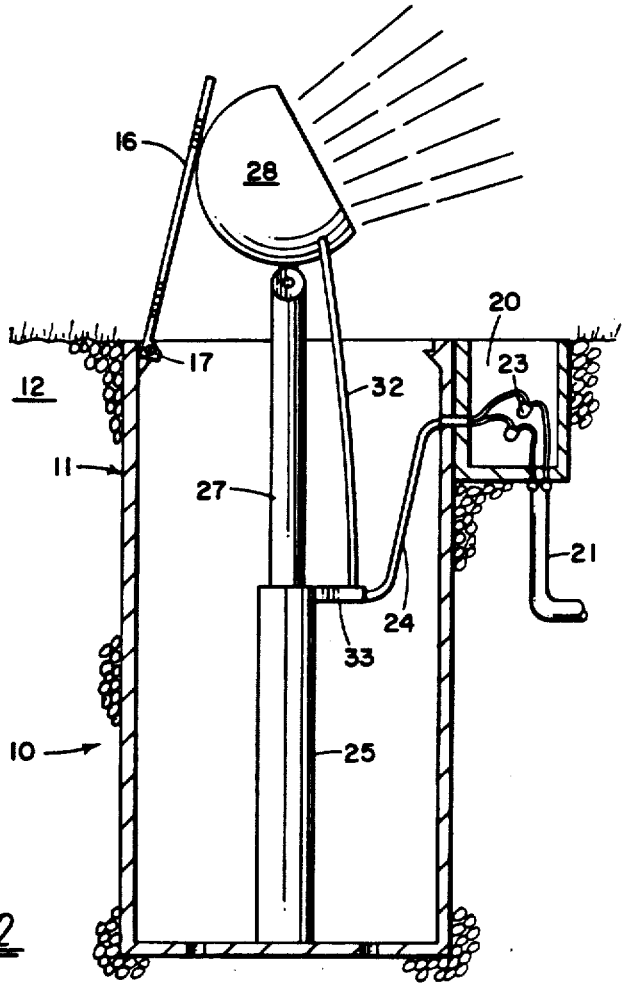
FIG. 2 is a sectional view of the retractable light fixture of FIG. 1 in an extended position.

Referring to the drawings, FIGS. 1-6, a retractable lighting fixture 10 is shown having a housing 11 mounted in the earth 12. The housing 11 has sides 13, a bottom 14 having a plurality of drainage holes 15, and an open top covered by a cover 16 hinged with a hinge 17 to the housing 11. The housing has a small ledge 18 for the hinged cover 16 to support the cover in a closed position. An electrical box 20 is mounted adjacent the housing 11 and has a pair of conductors 21 passing thereinto. The conductor is connected remotely to a single pole switch and is connected with solderless terminals 23 in the electrical box 22 to electrical conductor 24. A lamp solenoid 25 may be fixedly mounted at 26 to the bottom 14 of the housing 11 and has an extendable lamp solenoid arm 27 having a lamp 28 mounted thereto with a swivel or hinged connector 30 so that the lamp 28 may be adjusted for a different positions. A light cord 32 can be raised and lowered as the solenoid arm 27 moves from a retracted position in FIG. 1 to an extended position in FIG. 2.

Figure 3:
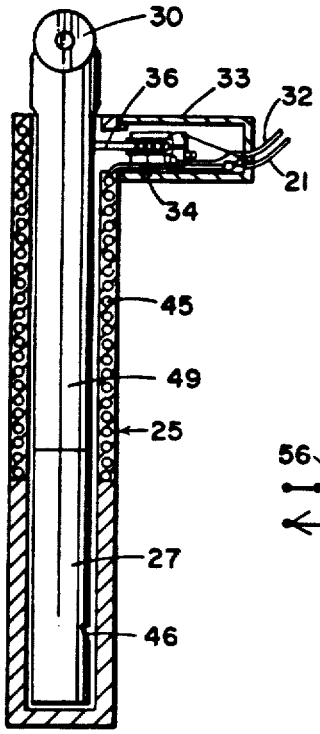
FIG. 3 is a sectional view taken through the solenoid and switch of FIGS. 1 and 2.
Figure 4:
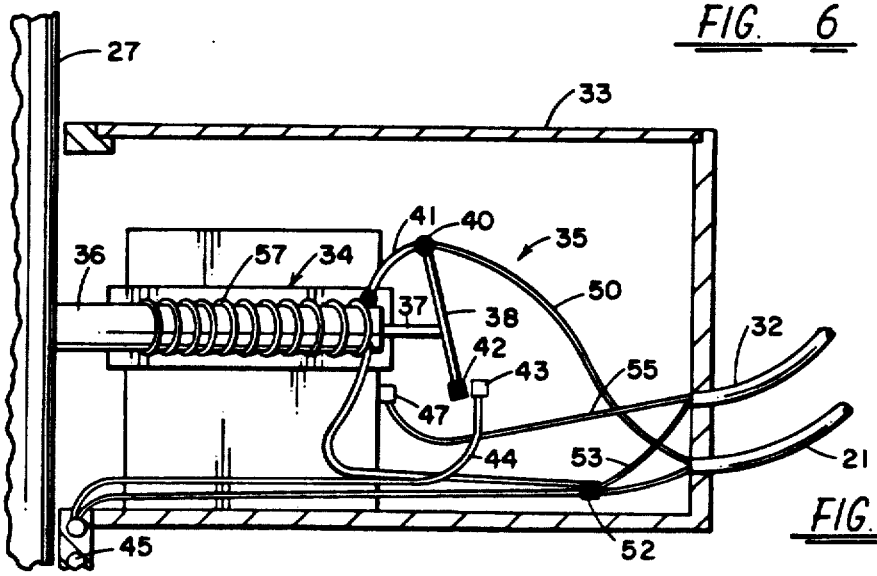
FIG. 4 is a sectional view taken through the latching switch of the light fixture in accordance with FIGS. 1-3.

Referring to FIGS. 3 and 4, a latching solenoid housing 33 has a latching solenoid 34 mounted therein which has a switch 35 interconnected therewith. Latching solenoid 34 has a latching solenoid arm 36 which may be spring loaded to a retracted position. The solenoid 34, latching arm 36 can be seen riding against the surface of the lamp solenoid arm 27 and can be seen having a solenoid switch arm 37 extending out the other end and forming a part of a switch lever arm 38 which pivots on a hinge point 40 and is supported on the arm 41. The switch arm 38 has a contact 42 on the end thereof which may contact a contact 43 which is connected by a conductor 44 to a coil 45 forming the coil for the lamp solenoid 25 so that when the latching solenoid is in the position of FIG. 4, power is produced in the coil 45 to raise the solenoid arm 27 and the lamp 28 thereon. This in turn drives the cover 16 upward on its hinge 17 to a raised position until such time as the latching solenoid arm 36 is driven into a notch 46 (FIG. 3) in the lamp solenoid arm 27. This withdraws the switch arm 38 to pull it from contact 43 to contact 47 thereby turning off the power through the conductor hot line 50 and through the switch arm 38 and through the contact 43 and conductor 44 to the coil 45. A neutral line 51 may be seen connected with a connector 52 to the neutral 53 of the lamp power line 54 and the hot line 50 is also connected through the switch arm 38 and contact 42 and contact 47 to the hot line 55 for the lamp 28. The solenoid arm 27 has a nonmagnetic portion 49 which can be any non-magnetic material, such as a polymer.

Figure 5:
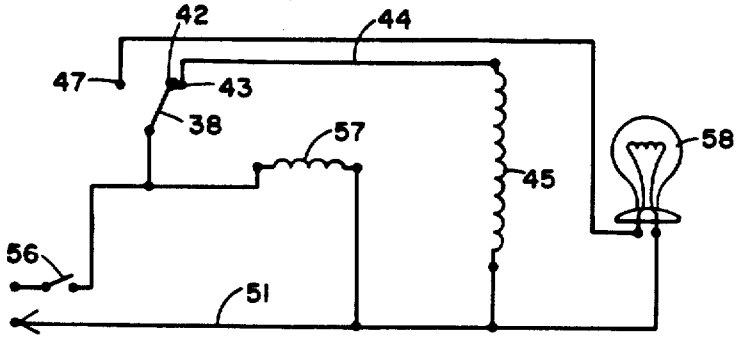
FIG. 5 is a schematic diagram of the operation of the latching switch and lamp when the lighting fixture is in the position shown in FIG. 1.
Figure 6:
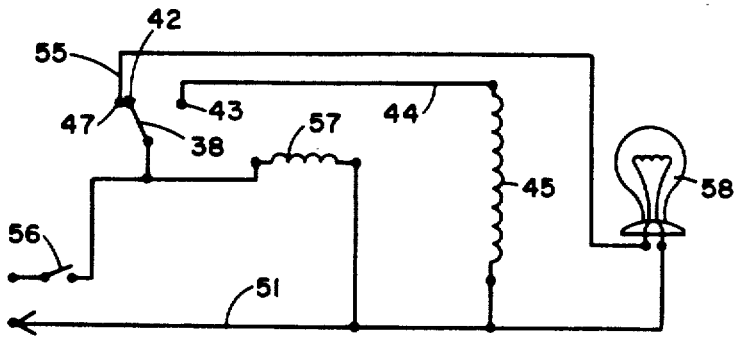
FIG. 6 is a schematic diagram of the lighting fixture switch as in FIG. 2 with the lamp raised from the fixture and turned off.

This may be seen in connection with FIGS. 5 and 6 in which a remote single pole, single throw switch 56 can actuate the hot line 50 to pass through the switch arm 38 and through the line 44 and through the coil 45 in the lamp solenoid 25 and back to the neutral line 51. Anytime the power is turned on, the hot line 50 is connected through the coil 57 of the latching solenoid 34 and anytime the switch 56 is turned off, power is cut to the latching solenoid 57. In FIG. 5, the power is connected to raise the arm 27 of the lamp solenoid 25 until it reaches the position where the latching arm 36 connects to the latching notch 46 within the arm 27. As shown in FIG. 6, the switch 38 is then connected to the line 55 and is disconnected from the line 44 so that power is cut to the lamp solenoid coil 45 and is connected to the lamp hot line 55 to turn the lamp 58 on. Once the switch 56 is turned, power is cut to the latching solenoid 57 which retracts and disconnects the lamp 58 and reconnects the power to the lamp solenoid coil 45 as the lamp solenoid arm 47 is dropping through the force of gravity since the power has been cut off from the entire system at this time.

Figure 7:
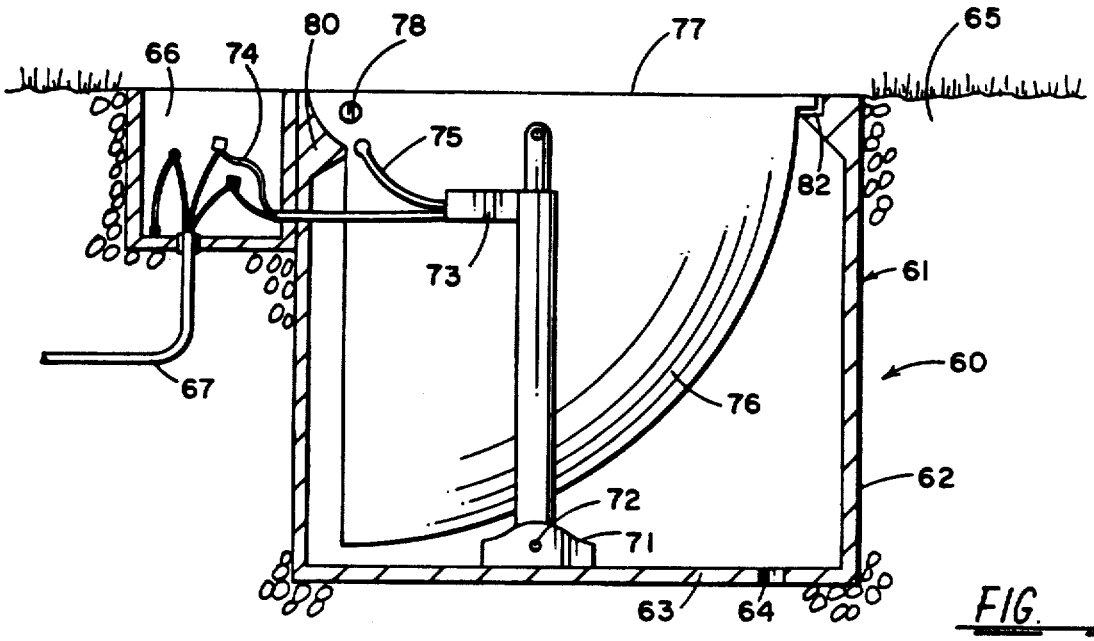
FIG. 7 is a sectional view of an alternate embodiment of a retractable light fixture in accordance with the present invention in a retracted position.
Figure 8:
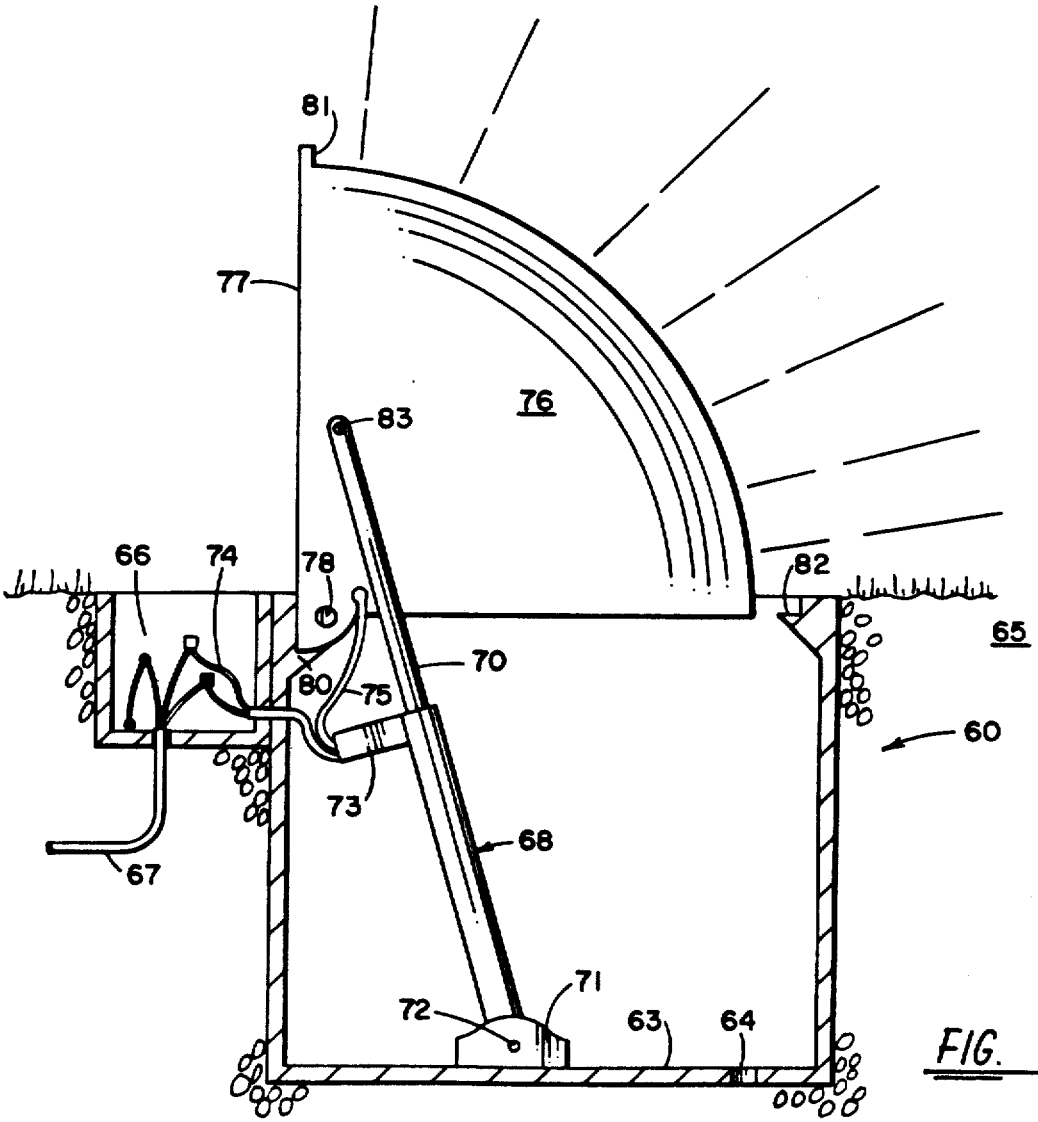
FIG. 8 is a sectional view of the light fixture of FIG. 7 having a light in an extended position.

Turning now to FIGS. 7 and 8, an alternate embodiment of a retractable light fixture is illustrated having a housing 61 having sides 62, a bottom 63, and drain holes 64 and being mounted in the earth 65. An electrical box 66 is mounted adjacent the housing 61 and has an electrical conductor 67 feeding underground from a remote switch and power source into the electrical box 56. The conductors then feed into the housing 61 through the side 62. The lamp solenoid 68 has a telescoping solenoid arm 70 retracted in FIGS. 7 and extended in FIG. 8. The solenoid 68 is mounted to a yoke 71 with a pin 72 which allows the solenoid 68 to be movably mounted in the yoke 71. A latch pin housing 73 is attached to the side of the solenoid 68 and operates in the same manner as that shown in FIGS. 3-6. A conductor 74 connects the conductor 67 to the latching pin and switch 73 and a conductor 75 connects the power to a lamp 76. The lamp 76 has a generally segmented shape and is mounted directly to the cover or lid 77 for the housing 61 and is hinged with a pin 78 to a hinge pin bracket 80. The cover 77 has a protruding ledge 81 extending over the lamp edge 76 and adapted to fall on a ledge 82 formed on the edge of the housing 61. The solenoid arm 70 has a hinge pin 83 attaching the end of the arm 70 to the side of the lamp 76.

The lamp 76 and cover 77 are actuated in the same manner as the retractable light fixtures of FIGS. 1-6 and is shown in the retracted position in FIG. 7 and in an extended position in FIG. 8 with the cover 77 raised by rotating the cover on the pin 78 and thereby raising the lamp 76 to a fixed position. Retracting the lamp solenoid 68, as shown in FIG. 7, closes the cover and retracts the light into the housing 61 which is mounted in the earth 65.

It should be clear at this point that a retractable light fixture has been provided which automatically raises the light to a desired position upon turning a light switch to the on position which light switch may be located remotely inside a building and that the light fixture may be turned off and retracted by turning the remote light switch to an off position. It should also be clear that the remote light switch can be an electrical or solid state timer switch to actuate the light fixture on a timed cycle. However, it should be clear that other forms and embodiments are considered within the scope of the present invention and the forms shown are to be considered illustrative rather than restricted.

I claim:

1. A retractable light fixture comprising:

a housing having sides, a bottom and an opening lid attached thereto;

a lamp;

an electrically actuated lamp solenoid attached inside said housing and having a solenoid arm having said lamp attached thereto for raising said lamp through said housing lid in an extended position and for lowering said lamp and housing lid when said lamp solenoid is lowered to return said lamp inside said housing;

electrical conductor connected between an electrical power source and to said lamp solenoid and to said lamp for powering said lamp and lamp solenoid, said electrical conductor having a remote switch therein;

latch means for holding said solenoid arm and lamp thereon in an extended position, said latch means disengaging the power to said solenoid when in a latched position and switching on the power to said lamp when said latch is in an engaged position, whereby said light fixture raises said lamp and turns said lamp on upon electrical power being applied to said light fixture by actuating said remote switch in said electrical conductor and returns said lamp into said housing and switches said lamp off when power thereto is disengaged through said remote switch.

2. A retractable light fixture in accordance with claim 1 in which said latch means includes a spring loaded switch solenoid.

3. A retractable light fixture in accordance with claim 2 in which said switch solenoid has a protruding solenoid arm which extends into a notch in said lamp solenoid arm when said lamp solenoid arm is in a raised position to thereby hold said lamp solenoid extending arm in a raised position.

4. A retractable light fixture in accordance with claim 3 in which said switch solenoid protruding solenoid arm has a switch attached thereto which disconnects electrical power to said lamp solenoid when extended into said lamp solenoid arm notch.

5. A retractable light fixture in accordance with claim 4 in which said switch solenoid switch connects electrical power to said lamp when said switch solenoid arm is extended into said lamp solenoid extending arm notch and disconnects electrical power to said lamp when said switch solenoid arm is disengaged from said lamp solenoid arm notch.

6. A retractable light fixture in accordance with claim 5 in which said latch means spring loaded switch solenoid has a spring biasing said switch solenoid arm away from said lamp solenoid arm.

7. A retractable light fixture in accordance with claim 6 in which said housing is a cylindrical water proof housing having a waterproof hinged lid attached thereto.

8. A retractable light fixture in accordance with claim 7 in which lamp solenoid is attached to the bottom of said housing and said switch solenoid is attached generally perpendicular to said lamp solenoid.

9. A retractable light fixture in accordance with claim 8 in which said lamp is fixedly attached to said lamp solenoid arm with a swivel connector whereby said lamp can be adjusted to different positions.

* * * * *